US007193571B2

(12) United States Patent
Inatsugu et al.

(10) Patent No.: US 7,193,571 B2
(45) Date of Patent: Mar. 20, 2007

(54) COMPOSITE ANTENNA

(75) Inventors: Susumu Inatsugu, Hirakata (JP); Kazuhiko Fujikawa, Kyotanabe (JP); Masami Segawa, Izumi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 52 days.

(21) Appl. No.: 11/046,765

(22) Filed: Feb. 1, 2005

(65) Prior Publication Data

US 2005/0174291 A1 Aug. 11, 2005

(30) Foreign Application Priority Data

Feb. 9, 2004 (JP) ..... 2004-031767

(51) Int. Cl.
*H01Q 1/24* (2006.01)

(52) U.S. Cl. ..... 343/702; 343/846

(58) Field of Classification Search ..... 343/702, 343/700 MS, 846
See application file for complete search history.

(56) References Cited

U.S. PATENT DOCUMENTS 4,074,270 A 2/1978 Kaloi
4,233,607 A 11/1980 Sanford et al.
6,295,030 B1 * 9/2001 Kozakai et al. ..... 343/700 MS
6,326,924 B1 * 12/2001 Muramoto et al. ..... 343/702
6,343,208 B1 1/2002 Ying
6,549,169 B1 * 4/2003 Matsuyoshi et al. ..... 343/702
6,768,460 B2 * 7/2004 Hoashi et al. ..... 343/700 MS
7,019,709 B2 * 3/2006 Fukushima et al. ..... 343/846
2002/0140612 A1 10/2002 Kadambi et al.

FOREIGN PATENT DOCUMENTS

JP 8-237025 9/1996
JP 10-290113 10/1998
JP 2000-183643 6/2000
JP 2002-76751 3/2002

OTHER PUBLICATIONS

McEwan et al., "A new Design of Horizontally Polarized and Dual-Polarized Uniplanar Conical Beam Antennas for HIPERLAN", *IEEE Transactions on Antennas and Propagation*, vol. 51, No. 2, pp. 229-237, Feb. 2003.

* cited by examiner

*Primary Examiner*—Hoang V. Nguyen
(74) *Attorney, Agent, or Firm*—Wenderoth, Lind & Ponack, L.L.P.

(57) ABSTRACT

A composite antenna has a conductor ground plate having a preset shape, a plurality of antenna elements faced to each other and separated from the conductor ground plate by predetermined element interval, and feeding terminals for feeding power to the antenna elements via transmission lines in the same phase. The antenna elements and the feeding terminals are disposed symmetrically with respect to the center of the conductor ground plate. Even when the number of operating frequencies is increased to three or more, the composite antenna is thin and small and can provide a predetermined directional characteristic.

4 Claims, 4 Drawing Sheets

COMPOSITE ANTENNA

BACKGROUND OF THE INVENTION

1. Field of the Invention

The present invention relates to a composite antenna for use in an on-vehicle mobile radio device or the like.

2. Background Art

A monopole antenna that has a rod shape and one operating frequency has been recently and generally used as an antenna for use in an on-vehicle mobile device or the like. Wire length (antenna length) of the monopole antenna, however, must be about ¼ wavelength or longer of the operating frequency. The monopole antenna is not suitable for use in a mobile body such as an automobile or a portable apparatus.

Service such as a car telephone, a global positioning system (GPS), a vehicle information communication system (VICS), or data communication is diversified in a mobile body such as an automobile. When a monopole antenna is loaded into the mobile body in each application, the number of installed antennas must be increased. These antennas are generally attached to the outside of the car body, and attaching many antennas damages the appearance of the automobile. Therefore, a small composite antenna capable of adapting to a plurality of operating frequencies required for a plurality of applications is proposed. This composite antenna is attached to the inside or outside of the car body.

FIG. 6 is a longitudinal sectional view of a composite antenna disclosed in Japanese Patent Unexamined Publication No. 2000-183643. Composite antenna 700 is formed by integrating first antenna 500 and plane antenna 600.

First antenna 500 has conductor ground plate 510, antenna element 530, feeding terminal 520, and short circuit terminal 540. Conductor ground plate 510 is formed of a conductive plate. Antenna element 530 is formed of a conductive plate smaller than conductor ground plate 510, is separated from conductor ground plate 510 by predetermined set interval 550, and is disposed in parallel with conductor ground plate 510. One end of feeding terminal 520 is electrically connected to the center of antenna element 530 at feeding point 521, and the other end thereof is penetrated through the center of conductor ground plate 510 in an insulating state and connected to signal source 400 on the back side of conductor ground plate 510. Short circuit terminal 540 is formed of a conductive material, and electrically connects antenna element 530 to conductor ground plate 510 at a position separated from the center of conductor ground plate 510 by predetermined distance 650.

Plane antenna 600 includes planar antenna element 630 and feeding terminal 620. Antenna element 630 is placed on the upper surface of antenna element 530. One end of feeding terminal 620 is electrically connected to antenna element 630 at feeding point 621. The other end thereof is penetrated through conductor ground plate 510 and short circuit terminal 540 in an insulating state, and is connected to signal source 450 on the back side of conductor ground plate 510.

In this configuration, composite antenna 700 transmits or receives two frequencies, namely operating frequencies fa and fb, with first antenna 500 and plane antenna 600, respectively.

For making the conventional composite antenna adapt to three or more operating frequencies, however, the entire height of the composite antenna must be increased. In other words, for adapting to three or more operating frequencies, a second antenna similar to first antenna 500 must be formed on first antenna 500, and plane antenna 600 must be placed on the upper surface of the second antenna. Therefore, disadvantageously, the larger the number of operating frequencies, the bulkier the composite antenna is.

Japanese Patent Unexamined Publication No. H08-237025 discloses a composite plane antenna that is apparently one antenna and can support many kinds of communication services. The composite plane antenna has the following elements:

- a folded monopole antenna with a metal plate that is formed by short-circuiting a conductor ground plate and a metal loaded plate with a short-circuiting means;
- one or more antennas supported over the loaded plate; and
- a feeding means that penetrates the folded monopole antenna and feeds power to one or more antennas.

Also in this configuration, the height of the entire antenna must be disadvantageously increased for adapting to three or more operating frequencies.

The present invention addresses the conventional problems, and provides a thin and small composite antenna capable of adapting to three or more operating frequencies.

SUMMARY OF THE INVENTION

A composite antenna of the present invention has the following elements:

- a conductor ground plate having a preset shape;
- a plurality of antenna elements faced to each other and separated from the conductor ground plate by a predetermined element interval; and
- feeding terminals for feeding power to the antenna elements via transmission lines in the same phase.

The antenna elements and feeding terminals are disposed symmetrically with respect to the center of the conductor ground plate.

A configuration may be employed where the antenna elements are disposed at respective ends of the conductor ground plate, and space is formed in a central part of the conductor ground plate.

The feeding terminals may be separated from respective centers of the antenna elements by a predetermined eccentric distance.

Short circuit terminals for electrically connecting the antenna elements to the conductor ground plate may be disposed symmetrically with respect to the center of the conductor ground plate and in parallel with the feeding terminals.

The inter-element distance between the antenna elements may be set in response to a directional characteristic of transmitted or received radio wave.

First distance L1 and second distance L2 may be set at lengths equivalent to ¼ of the wavelengths corresponding to different operating frequencies. Here, first distance L1 is assumed to be the distance between each feeding point for electrically connecting each feeding terminal to each antenna element and one end of the antenna element. Second distance L2 is assumed to be the distance between the feeding point and the other end of the antenna element.

In this configuration, space can be formed in the center of the conductor ground plate, so that a well known plane antenna or the like can be disposed in this space. Disposing the plane antenna in such space can keep the height of the composite antenna low even when the number of operating frequencies is increased to three or more.

When the plurality of antenna elements are disposed at ends of the conductor ground plate, a set directional characteristic can be easily obtained with the conductor ground plate kept in a predetermined shape.

When the feeding terminals are separated from respective centers of the antenna elements by a predetermined eccentric distance, two operating frequencies can be easily obtained.

When short circuit terminals for electrically connecting the antenna elements to the conductor ground plate are disposed symmetrically with respect to the center of the conductor ground plate and in parallel with the feeding terminals, short circuit terminals are excited in a phase that is the same as those of the feeding terminals and hence the exciting strength can be increased. As a result, a composite antenna short in height can be realized.

In the present invention, even when the number of operating frequencies is increased to three or more, a thin and small composite antenna can be obtained, a directional characteristic can be provided, and the composite antenna can be used in an on-vehicle mobile radio device or the like.

DETAILED DESCRIPTION OF THE INVENTION

Figure 1:
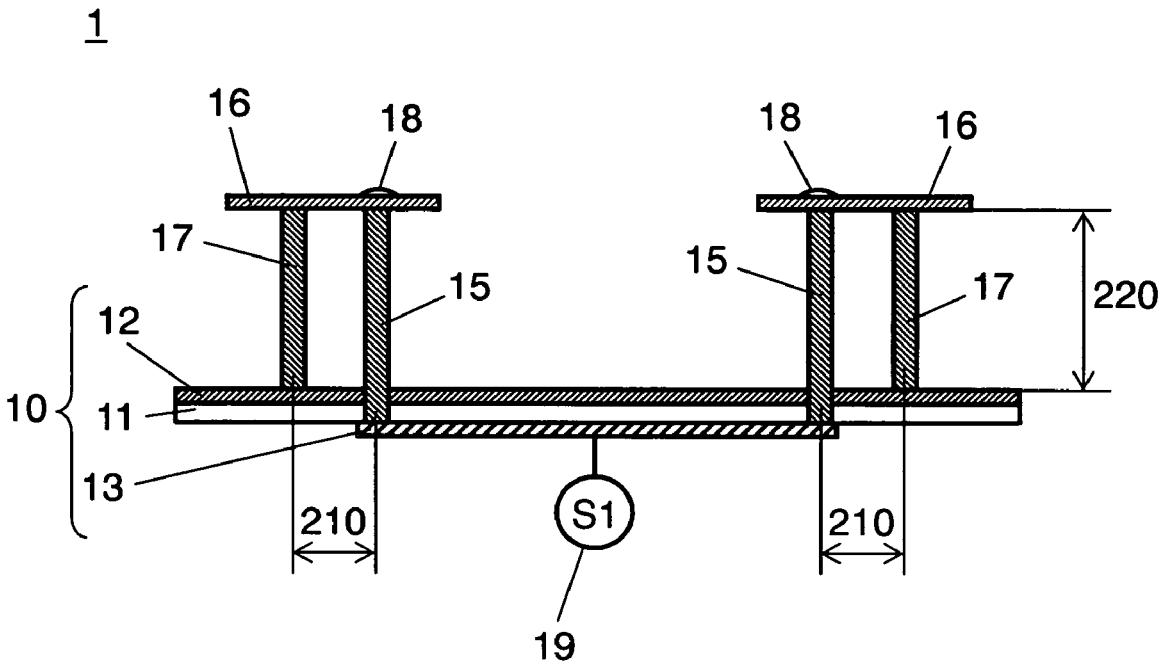
FIG. 1 is a longitudinal sectional view of a composite antenna in accordance with an exemplary embodiment of the present invention.

A composite antenna in accordance with an exemplary embodiment of the present invention will be described hereinafter with reference to the drawings. Same elements are denoted with the same reference numbers in the drawings, and the descriptions of those elements are omitted.

Figure 2:
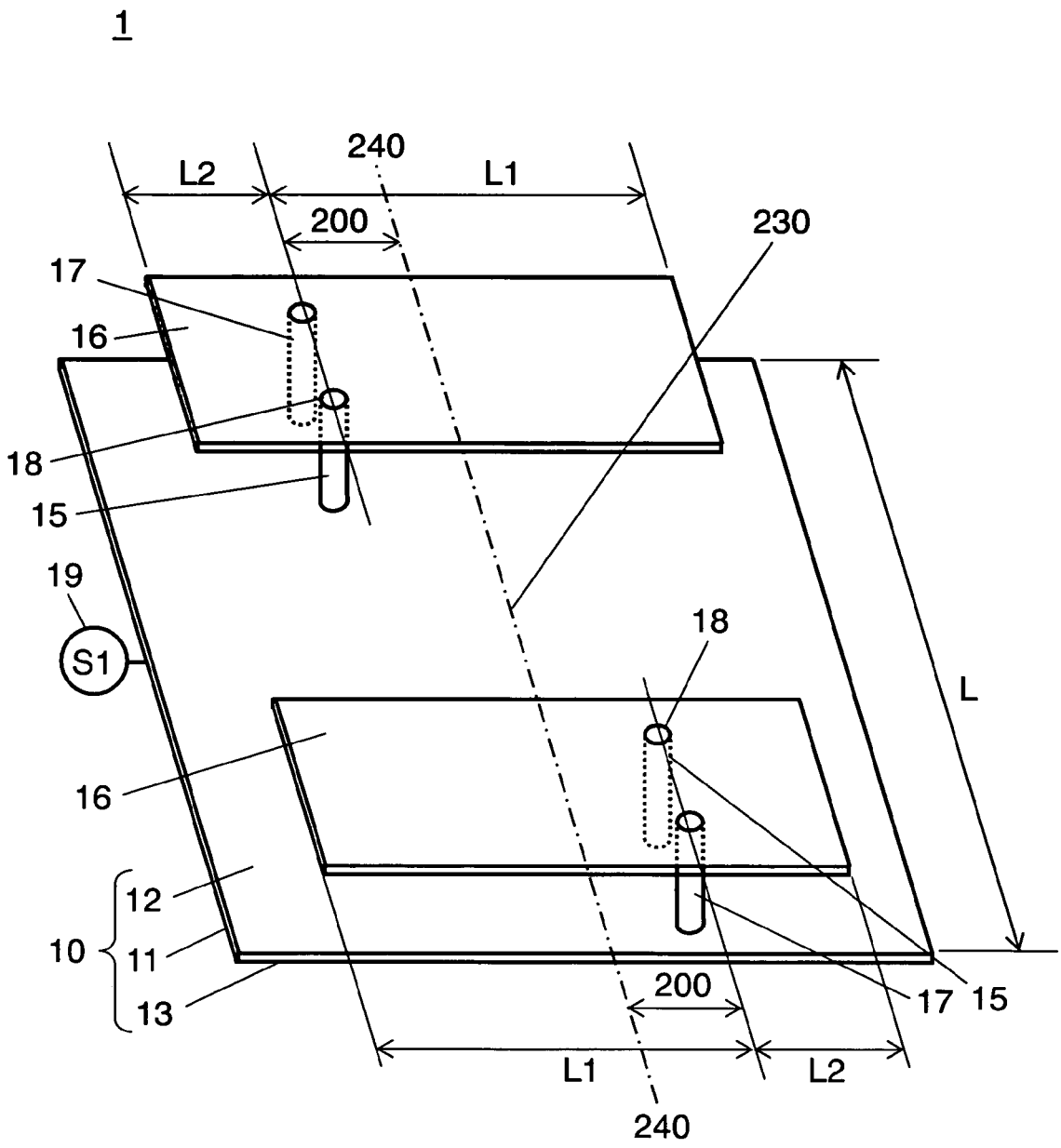
FIG. 2 is a perspective view of the composite antenna in accordance with the exemplary embodiment.

FIG. 1 is a longitudinal sectional view of composite antenna 1 in accordance with an exemplary embodiment of the present invention. FIG. 2 is a perspective view of composite antenna 1. Composite antenna 1 of the present embodiment can adapt to two frequencies. Substrate 10 has good conductors such as copper foil on both surfaces of insulating plate 11 in its central part. Transmission line 13 formed of copper foil or the like by etching is disposed on the lower surface of insulating plate 11, and conductor ground plate 12 having a substantially square shape of which one side length is L is disposed on the upper surface of insulating plate 11.

Two antenna elements 16 are faced to each other, and separated from conductor ground plate 12 by predetermined element interval 220. Each of two antenna elements 16 is connected to one end of feeding terminal 15 at feeding point 18. The other end of feeding terminal 15 is made to penetrate conductor ground plate 12 in an insulating state, is connected to transmission line 13 on the back side of substrate 10, and is connected to signal source 19 through transmission line 13.

A feeding route from signal source 19 is formed so as to feed power in the same phase to each antenna element 16 through transmission line 13, each feeding terminal 15, and each feeding point 18.

Antenna elements 16, feeding terminals 15, and short circuit terminals 17 are disposed at ends of conductor ground plate 12 symmetrically with respect to center 230 of conductor ground plate 12. Antenna elements 16, feeding terminals 15, and short circuit terminals 17 have substantially same shapes, respectively. The short circuit terminals 17 electrically connect two antenna elements 16 to conductor ground plate 12, and are disposed in parallel with respective feeding terminals 15. Each short circuit terminal 17 and feeding terminal 15 are separated from the center line (line 240–240 of FIG. 2) of each antenna element 16 by predetermined eccentric distance 200.

Two antenna elements 16 are preferably positioned in ranges where antenna elements 16 do not lie off the upward extensions of the outer peripheral ends of conductor ground plate 12.

Each short circuit terminal 17 and feeding terminal 15 are separated from the center line (line 240–240 of FIG. 2) of each antenna element 16 by predetermined eccentric distance 200. Distance (hereinafter called first distance) L1 from short circuit terminal 17 and feeding terminal 15 to one end of antenna element 16 is different from distance (hereinafter called second distance) L2 from short circuit terminal 17 and feeding terminal 15 to the other end of antenna element 16. First distance L1 is set at substantially ¼ wavelength of operating frequency f1. Second distance L2 is set at substantially ¼ wavelength of operating frequency f2. Length L of one side of conductor ground plate 12 and distances L1 and L2 satisfy $L \geqq L1+L2$. In FIG. 2, they are set to satisfy $L<L1+L2$.

Composite antenna 1 of the present embodiment can adapt to two operating frequencies thanks to this configuration. In a transmission operation of composite antenna 1, high-frequency signals from signal source 19 are fed in the same phase to two antenna elements 16 through the feeding routes. Therefore, two antenna elements 16 simultaneously operate just like one antenna element. Operating frequency f1 corresponding to first distance L1 and operating frequency f2 corresponding to second distance L2 are excited in each antenna element 16, and radio waves corresponding to these frequencies are emitted in the air.

In a receiving operation, operating frequency f1 is excited on the first distance L1 side, and operating frequency f2 is excited on the second distance L2 side in each antenna element 16. Signals of these frequencies are transmitted to signal source 19 in the reverse direction in the feeding routes, fed into a high-frequency circuit (not shown), and received.

In the present embodiment, two antenna elements 16 have first distance L1 and second distance L2 different from each other and correspond to two operating frequencies. However, the present invention is not limited to this. When first distance L1 and second distance L2 are set equal, for example, two antenna elements can adapt to one operating frequency.

Short circuit terminals 17 are aimed at impedance matching. Inter-terminal distance 210 between feeding terminal 15 and short circuit terminal 17 can be set in response to impedances of two antenna elements 16 and operating frequencies.

Next, a method of obtaining an emitting direction (hereinafter called a directional characteristic) of radio wave emitted by composite antenna 1 and a predetermined directional characteristic is described hereinafter.

Figure 3:
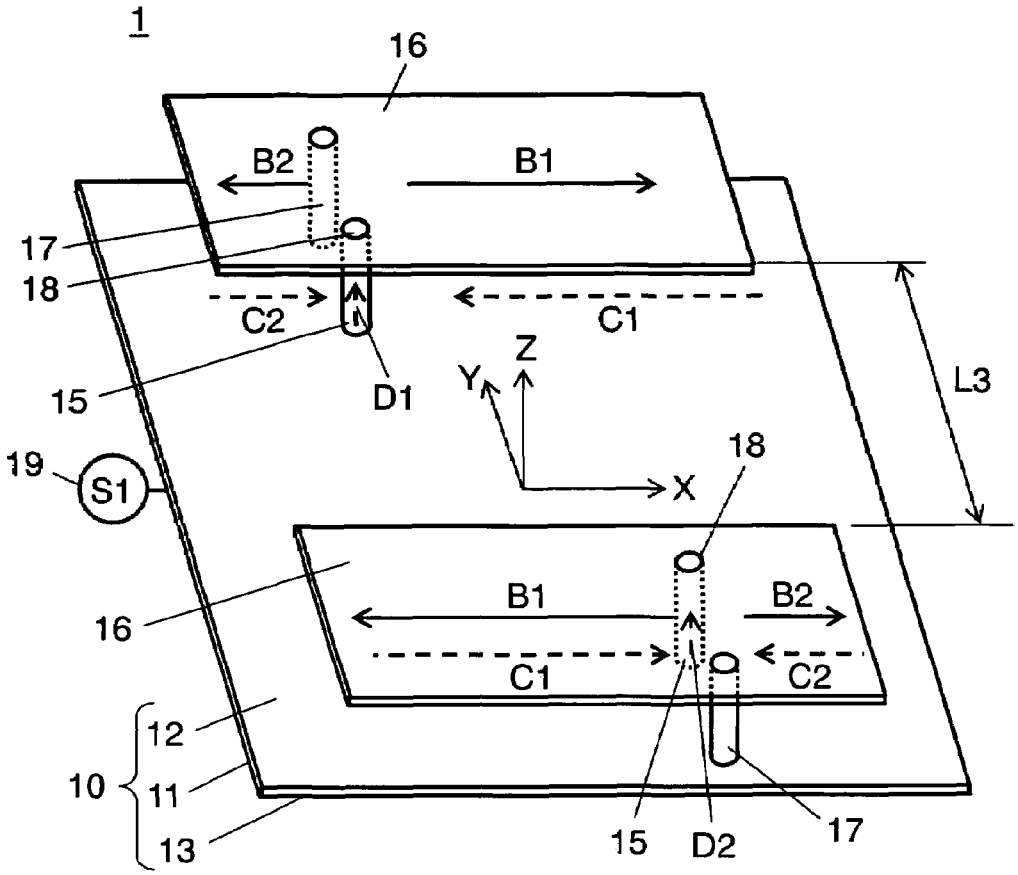
FIG. 3 is a schematic diagram of high-frequency current flowing in each component of the composite antenna in accordance with the exemplary embodiment.

FIG. 3 is a schematic diagram of high-frequency current flowing in each component of composite antenna 1. FIG. 3 also includes coordinate axes (X-axis, Y-axis and Z-axis) showing three-dimensional direction of composite antenna 1. In composite antenna 1, high-frequency currents are fed to two antenna elements 16 in the same phase. Therefore, high-frequency currents B1 and B2 flow simultaneously in two antenna elements 16, high-frequency currents C1 and C2 flow simultaneously in conductor ground plate 12, and high-frequency currents D1 and D2 flow simultaneously in two feeding terminals 15.

High-frequency currents B1 and B2 flowing simultaneously in two antenna elements 16 have the same strength and reverse direction, so that the currents cancel each other out. High-frequency currents C1 and C2 flowing simultaneously in conductor ground plate 12 also have the same amount and reverse direction, so that the currents cancel each other out. Total summation of the high-frequency current vectors in the X-axis direction (horizontal direction) shown in FIG. 3 is therefore zero, so that high-frequency currents in the X-axis direction do not contribute to the directional characteristic. In other words, high-frequency currents D1 and D2 flowing simultaneously in two feeding terminals 15 in the Z-axis direction (vertical direction) contribute to the directional characteristic. High-frequency currents D1 and D2 have the same phase.

In the directional characteristic of composite antenna 1, due to generation of an electromagnetic field by high-frequency currents in the Z-axis direction, radio wave is emitted about the Z-axis in the X-axis and Y-axis directions.

Figure 4:
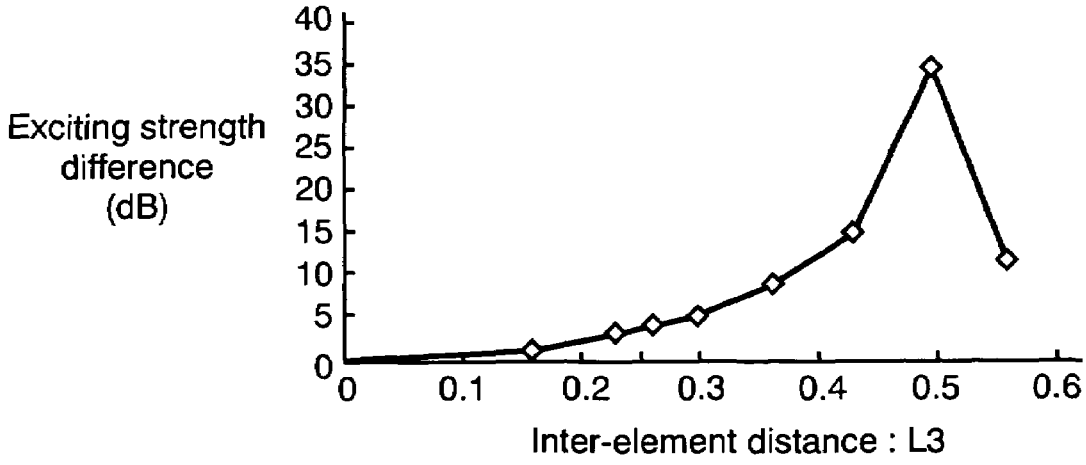
FIG. 4 is a diagram showing differential relation between exciting strength in the X-axis direction and exciting strength in the Y-axis direction when inter-element distance L3 between two antenna elements is varied in the composite antenna in accordance with the exemplary embodiment.

FIG. 4 is a diagram showing differential relation between exciting strength in the X-axis direction and exciting strength in the Y-axis direction in composite antenna 1 when distance between two antenna elements 16, namely inter-element distance L3, is varied. The horizontal axis shows inter-element distance L3 in reference to the wavelength derived from the operating frequency, and the unit of the distance is wavelength λ. The vertical axis shows the difference between the exciting strength in the X-axis direction and the exciting strength in the Y-axis direction. The directional characteristic diagram of FIG. 4 shows that varying inter-element distance L3 changes the exciting strength difference. When inter-element distance L3 is set zero, a concentric directional characteristic is obtained where exciting strength in the X-axis direction and exciting strength in the Y-axis direction equal to each other. The exciting strength in the X-axis direction increases with increase in inter-element distance L3, so that the exciting strength difference increases. The exciting strength difference is the largest when inter-element distance L3 is ½ of wavelength λ derived from operating frequency f1, namely 0.5λ, and decreases when inter-element distance L3 is larger than 0.5λ. When inter-element distance L3 is 0.5λ corresponding to the largest exciting strength difference, so called an elliptic directional characteristic is obtained.

In communications between a fixed station of a car telephone or the like and a mobile radio device, the directional characteristic can be the transmitting/receiving direction (emitting direction) of the radio wave. In this situation, for performing good transmitting/receiving with a conventional monopole antenna or the like having the concentric directional characteristic, transmitting/receiving power must be increased or the direction of the antenna must be varied. In the composite antenna of the present invention, however, a predetermined polarization plane and directional characteristic can be obtained by appropriately setting inter-element distance L3 between two antenna elements 16. Therefore, even when the composite antenna is disposed at an arbitrary position inside or outside the car body, the required polarization plane and directional characteristic can be obtained.

In one example of composite antenna 1 applied to a mobile radio device adapting to two frequencies (900 MHz band and 2000 MHz band), outside dimension L of conductor ground plate 12 is about 110 mm and element interval 220 between conductor ground plate 12 and antenna elements 16 is about 20 mm or shorter. It is verified that such composite antenna 20 adapting to two frequencies can secure band widths required for operations of the mobile radio device in both 900 MHz band and 2000 MHz band.

In the present embodiment, two facing antenna elements 16 separated from conductor ground plate 12 by predetermined element interval 220 are disposed symmetrically with respect to center 230 of conductor ground plate 12. As a result, space can be formed in the center of conductor ground plate 12, and a well known plane antenna or the like is disposed in the space and can easily transmit or receive three frequencies. Even when such a plane antenna is disposed, the entire composite antenna does not increase in height and is kept short in height.

Since two antenna elements 16 are disposed at ends of conductor ground plate 12, the directional characteristic allowing the transmitting or receiving in a predetermined direction can be obtained while the shape of conductor ground plate 12 and transmitting/receiving power are kept as they are.

Since each feeding terminal 15 is separated from the center of each antenna element 16 by eccentric distance 200, the composite antenna can easily adapt to two frequencies without using a new component member.

Since short circuit terminals 17 are disposed in parallel with feeding terminals 15, short circuit terminals 17 are excited in the same phase as that of feeding terminals 15 and hence the excitation is increased. Thus, the height of the composite antenna can be decreased.

Figure 5:
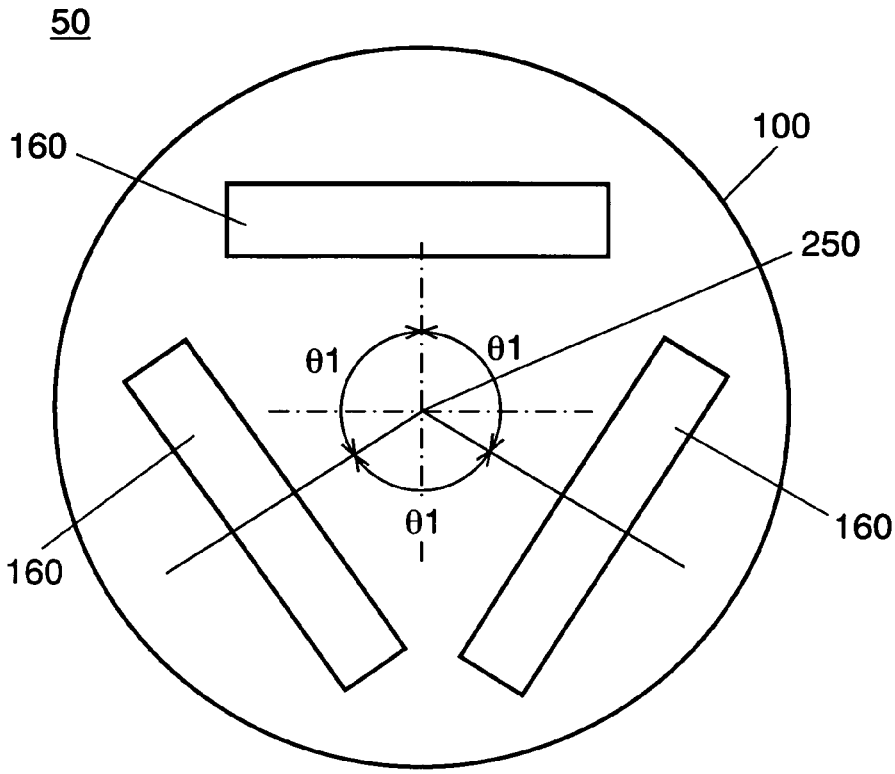
FIG. 5 is a schematic plan view illustrating a configuration of another composite antenna in accordance with the exemplary embodiment.
Figure 6:
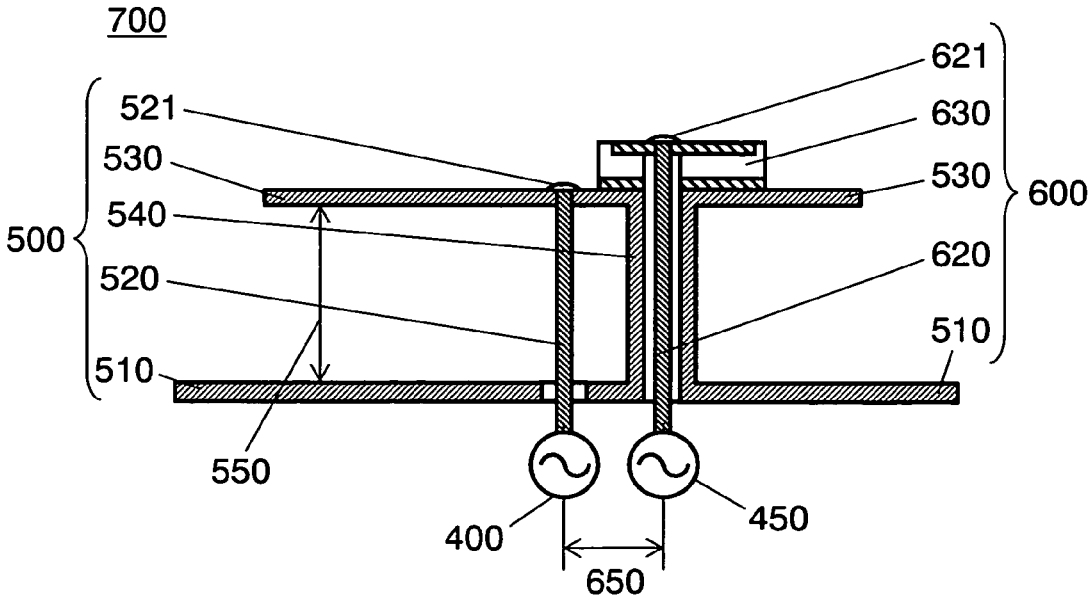
FIG. 6 is a longitudinal sectional view of a conventional composite antenna.

The composite antenna of the present embodiment has two antenna elements and a square conductor ground plate; however, the present invention is not limited to this. For example, composite antenna 50 shown in FIG. 5 may be employed. FIG. 5 is a schematic plan view illustrating a configuration of composite antenna 50 in accordance with the exemplary embodiment. In composite antenna 50, three antenna elements 160 having the same shape are disposed at an equal angle (θ1=120°) with respect to center 250 of circular conductor ground plate 100. Three antenna elements 160 have a same configuration as that of the present embodiment, so their description is omitted. In composite antenna 50, also, the total summation of the vectors of high-frequency currents flowing in the plurality of antenna elements and the conductor ground plate can be set zero, so that an advantage similar to that of composite antenna 1 of the present embodiment can be obtained. The present invention is not limited to this configuration. A configuration where total summation of the vectors of high-frequency currents flowing in a plurality of antenna elements and the conductor ground plate can be set zero is simply required.

What is claimed is:

1. A composite antenna comprising:

a conductor ground plate having a preset shape;

a plurality of antenna elements separated from the conductor ground plate by a predetermined element interval;

a plurality of feeding terminals for feeding power to the antenna elements via transmission lines in the same phase; and a plurality of short circuit terminals for electrically coupling the antenna elements to the conductor ground plate, wherein the antenna elements and the feeding terminals are disposed symmetrically with respect to a center point of the conductor ground plate, and wherein the short circuit terminals are disposed symmetrically with respect to the center point of the conductor ground plate and in parallel with the feeding terminals.

2. The composite antenna according to claim 1, wherein an inter-element distance between the antenna elements is set in response to a directional characteristic of radio wave to be transmitted and received.

3. The composite antenna according to claim 1 wherein the antenna elements are located on the same side of the conductor ground plate.

4. A composite antenna comprising:

a conductor ground plate having a preset shape;

a plurality of antenna elements separated from the conductor ground plate by a predetermined element interval; and a plurality of feeding terminals for feeding power to the antenna elements via transmission lines in the same phase, wherein the antenna elements and the feeding terminals are disposed symmetrically with respect to a center point of the conductor ground plate, and wherein, for each antenna element, a first distance L1 and a second distance L2 are set at lengths equivalent to ¼ of wavelengths corresponding to different operating frequencies, the first distance L1 being a distance between a feeding point for electrically coupling the feeding terminal to the antenna element and one end of the antenna element, and the second distance L2 being a distance between the feeding point and the other end of the antenna element.

* * * * *